US006037912A

United States Patent [19]

DeMarre

[11] Patent Number: 6,037,912

[45] Date of Patent: Mar. 14, 2000

[54] LOW PROFILE BI-DIRECTIONAL ANTENNA

[75] Inventor: Allen G. DeMarre, Irving, Tex.

[73] Assignee: Allen Telecom Inc., Beachwood, Ohio

[21] Appl. No.: 09/158,562

[22] Filed: Sep. 22, 1998

[51] Int. Cl.[7] ..... H01Q 21/12

[52] U.S. Cl. ..... 343/815; 343/817; 343/795; 343/806

[58] Field of Search ..... 343/795, 803, 343/806, 810, 812, 813, 814, 815, 816, 817, 818, 819, 872, 833, 834; H01Q 21/00, 21/12

[56] References Cited

U.S. PATENT DOCUMENTS

| | | | |
|---|---|---|---|
| 5,629,713 | 5/1997 | Mailandt et al. | 343/808 |
| 5,710,569 | 1/1998 | Oh et al. | 343/817 |
| 5,771,024 | 6/1998 | Reece | 343/725 |

*Primary Examiner*—Hoanganh Le
*Attorney, Agent, or Firm*—Laff, Whitesel & Saret, Ltd.

[57] ABSTRACT

A low profile bi-directional antenna is provided for mounting directly to a metal structure, or some other conductive or semi-conductive surface. The antenna includes an insulating antenna tray, a conductive ground plane mounted to a surface of the antenna tray, first and second radiating elements extending from the ground plane, and a radome covering the radiating elements and fastened to the insulating antenna tray. First and second reflector elements are mounted to the surface of the antenna tray on the lateral sides of the ground plane. The reflectors are electrically connected to the ground plane. The radiating elements are supported above and to the lateral sides of the ground plane and reflector elements by support members mounted at acute angles to the ground plane. An RF connector is provided for coupling RF signals to and from the first and second radiating elements.

26 Claims, 5 Drawing Sheets

LOW PROFILE BI-DIRECTIONAL ANTENNA

BACKGROUND OF THE INVENTION

The present invention relates to an antenna for use in mobile radio telephone applications.

A common feature of mobile radio telephone systems is the division of particular geographic service areas into smaller units known as cells. Within each cell, a group of relatively low power base stations provides RF communication services to mobile subscribers located within the particular cell. The type of antenna system selected for use within a cell is important for maximizing system efficiency and for providing a field pattern suitable for the particular geographic features of the coverage area. In a common configuration, for example, a cell is divided into six equal sectors. Each sector is served by a separate directional receive antenna having a radiation pattern closely resembling the sector shape. A single omni-directional transmit antenna typically serves the entire cell.

The configuration just described is well suited for open spaces where cells and cell sectors may be configured having a relatively uniform shape. In some case, however, geographic features or man made structures prevent radio signals from penetrating all areas within a cell, or cell sector. For example, RF signals have difficulty penetrating the inner reaches of tunnels, and mobile telephone service is frequently interrupted when a mobile subscriber enters a tunnel of any significant length. Downtown city streets are other locations where radio telephone antennas may have difficulty transmitting to all locations within a cell or cell sector. The tall steel structures of densely located high rise buildings can interfere with the field patterns of antennas which are mounted high above street level, thus interfering with phone transmissions to those subscribers located on the streets below.

In addition to field pattern concerns, mounting considerations often determine the applicability of a particular antenna design in certain special situations. For example, in some cases it is necessary to mount an antenna directly on or near a large planar metal surface. With most antenna designs a large conductive surface located near the antenna's radiating elements will distort the field pattern of the antenna, and create large standing waves on the transmission line feeding the antenna. Typical Voltage Standing Wave Ratios (VSWR) for antennas mounted directly to a conductive surface are in the range of 3:1 or 4:1 or even greater.

Providing uninterrupted mobile radio telephone coverage within long tunnels presents some of the more challenging design requirements for mobile telephone base antennas. To broadcast to or receive signals from all points within a long narrow tunnel, it has usually been necessary to provide a plurality of antennas and transceiver units for transmitting and re-transmitting signals to provide coverage throughout the tunnel.

Similarly, crowded city streets within urban centers pose many of the same problems for mobile radio telephone systems as do tunnels. The long narrow spaces defined by city streets running between high rise steel buildings have many attributes of a long narrow tunnel. The same field pattern and mounting concerns arise when mounting an antenna to the side of a steel building for purposes of providing coverage down the length of a narrow city street as when mounting an antenna to the steel inner surface of a tunnel.

Therefore, it would be desirable to provide a bi-directional antenna capable of being mounted directly to a large planar conductive surface without significant degradation in the field pattern of the antenna while maintaining a relatively low VSWR. It is further desired that such an antenna be constructed having a relatively low profile so as to not protrude significantly into the service area. Finally, a strong streamlined radome should be provided to protect the antenna components and improve the visual characteristics of the antenna.

SUMMARY OF THE INVENTION

In light of the background described above, a primary object of the present invention is to provide a low profile bi-directional antenna, and particularly, a low profile bi-directional antenna which may be mounted directly to a large conductive surface without significant degradation of the field pattern of the antenna.

According to the preferred embodiment of the invention a bi-directional antenna is provided comprising an insulating mounting tray, preferably formed of plastic. A conductive ground plane is mounted to the plastic antenna tray, and a pair of reflector elements are electrically connected to the ground plane on each lateral side thereof. A first radiator element is positioned above the tray and is laterally offset beyond an outer edge of the first reflector element. A second radiator element is similarly positioned above the tray, and is laterally offset beyond an outer edge of the second reflector element. Each of the radiator elements is supported by individual angled support members which are electrically connected to the conductive ground plane. Each support member forms an acute angle of approximately 30° to 40° relative to the antenna tray, and facing an outer edge thereof. Thus, the support members simultaneously lift the radiators off the surface of the tray, and extend the radiators beyond the outer edges of the reflector elements.

An RF connector is supplied for coupling signals either received by the antenna, or supplied to the antenna for broadcast. A coaxial transmission line couples the RF connector to a power divider. Depending on whether the signal is being transmitted or received, the power divider either adds the signals received by the each of the two radiating elements, or splits the broadcast signal between the two separate radiating elements. Additional coaxial transmission lines connect the output terminals of the power divider to the radiating elements.

In the preferred embodiment, the antenna further includes a low profile removable radome for covering and protecting the radiating elements of the antenna. The radome is constructed of plastic or fiber glass, or some other non-conductive material. The radome is further configured having tapered sidewalls, adding additional strength to the cover. A mounting flange surrounding the radome provides for mounting the radome to the tray.

In the preferred embodiment, the radiating elements comprise a pair of dipole radiators, with the arms of the dipoles extending parallel to the surface of the tray. The ends of the dipoles are bent slightly in order to allow the tapered walls of the radome to fit over the radiators. Further, the individual arms of the dipoles are formed integrally with the support members from a single piece of silver coated brass. Mounting brackets attached to the ground plane provide an angled mounting surface for attaching the base of the dipole supports. The relative position between the dipole elements and the reflector elements define the major axes of the two major lobes of the antenna's field pattern.

Significantly, the antenna of the present invention may be mounted directly on a metallic surface with very little detrimental effect to the antenna's field pattern. Furthermore, the antenna may be mounted directly to a conductive or partially conductive surface without generating significant standing waves on the input transmission line. The antenna of the present invention maintains a VSWR of less than 1.5:1 even when mounted directly to a large conductive surface such as the inner lining or surface of an underground tunnel.

Further objects, features and advantages of the present invention will become apparent from the following description and drawings.

DETAILED DESCRIPTION OF THE PREFERRED EMBODIMENT

Figure 1:
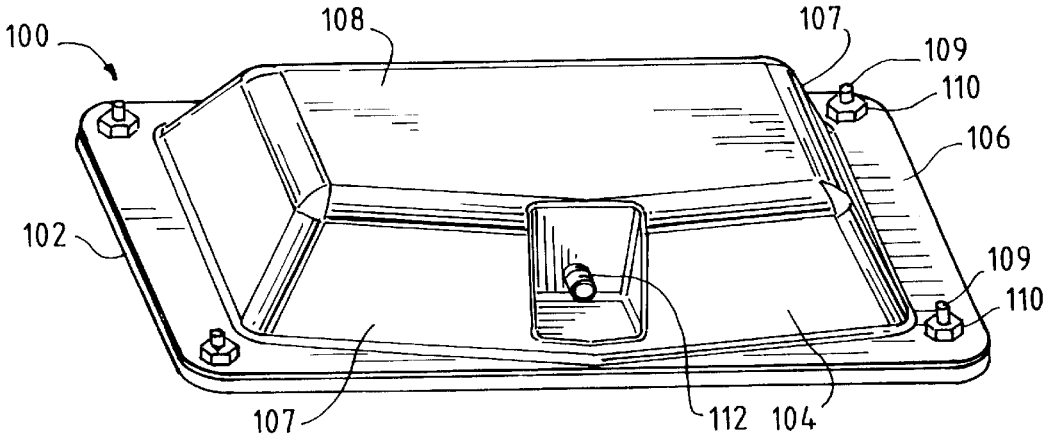
FIG. 1 is a perspective view of a low profile bi-directional antenna according to the present invention.

Referring to FIG. 1, a low profile bi-directional antenna according to the preferred embodiment of the invention is shown generally at 100. Antenna 100 includes a generally flat antenna tray 102 formed of a non-conductive material such as plastic. A radome 104 formed of a non-conductive plastic material, such as a UV stabilized ABS, is mounted to tray 102 and forms a protective cover for the antenna 100. Radome 104 includes tapered sidewalls 107 and a top surface 108 which together form a shallow cavity for housing antenna elements mounted to tray 102. A generally flat mounting flange 106 extends around the base of radome 104 providing a mounting surface for attaching the radome to the antenna tray 102. Screws 109 which pass through tray 102 and flange 106 and nuts 110, or some other fastener, may be employed to fasten the radome 104 to the tray 102. An RF connector 112 is mounted to the antenna components housed within radome 104. The connector protrudes from a hole in the radome sidewall 107, for connecting an external transmission line 113 such as a coaxial cable.

Figure 4:
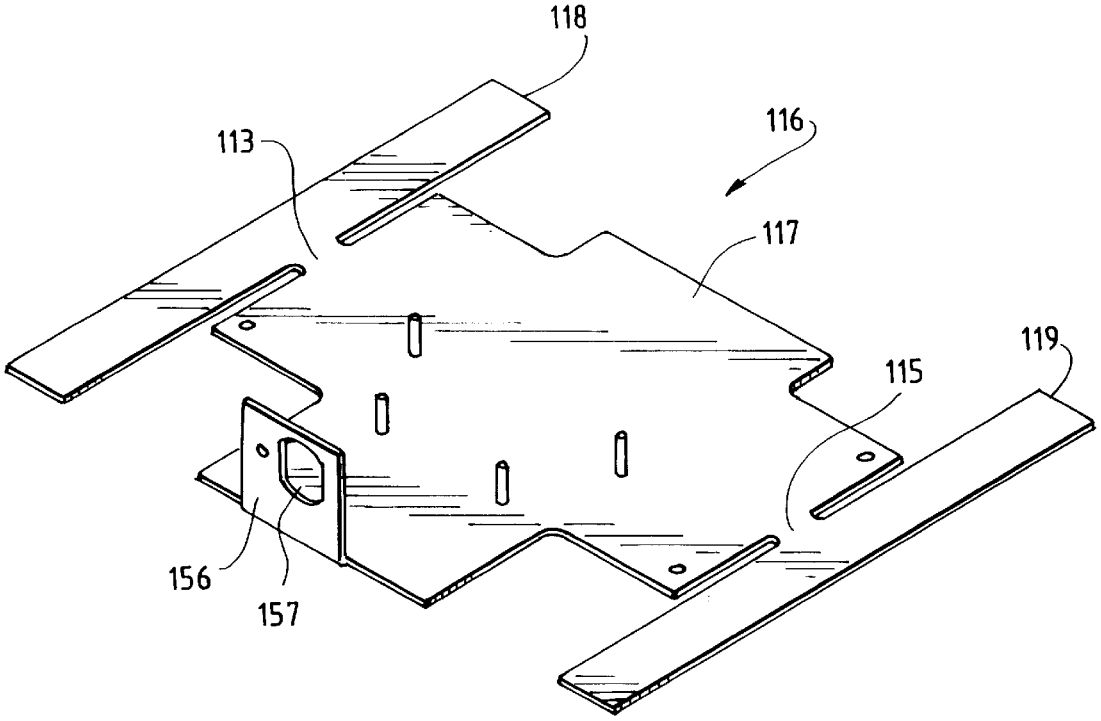
FIG. 4 is a perspective view of the ground plane of the antenna of FIG. 2;.

Antenna 100 further includes a conductive ground plane 116 mounted to a top surface 114 of the antenna tray 102. Ground plane 116 is formed of a single sheet of conductive material, preferably 16 gauge 304 stainless steel. The particular features of the ground plane are best seen in the perspective view of FIG. 4. The shape of the ground plane includes a relatively large cross shaped central region 117 flanked by a pair of elongated reflector elements 118, 119. Reflector elements 118, 119 are joined to the central region 117 by narrow connecting bridges 113, 115 respectively. A connector bracket 156 is formed at the lower end of ground plane 116. The bracket is formed integrally with ground plane 116, comprising a metal tab extending from the ground plane which is bent at a 90° angle thereto. A mounting hole 157 is formed in bracket 156 to receive the RF connector 112. The RF connector may be grounded via an external coaxial cable feeding antenna 100. Ground plane 116, reflectors 118, 119, and connector mounting bracket 156 being formed from a single sheet of metal, are all electrically connected such that with the RF connector 112 grounded, all will be maintained at the same grounded potential.

Figure 2:
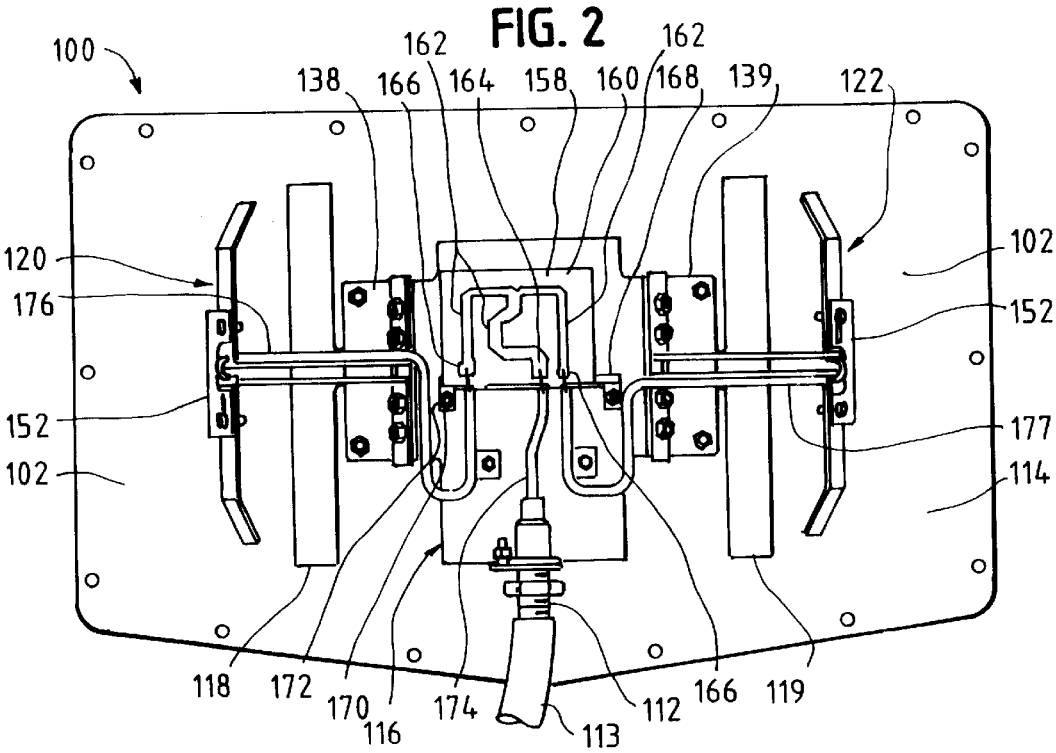
FIG. 2 is a plan view of the antenna of FIG. 1 having the protective radome removed therefrom.
Figure 3:
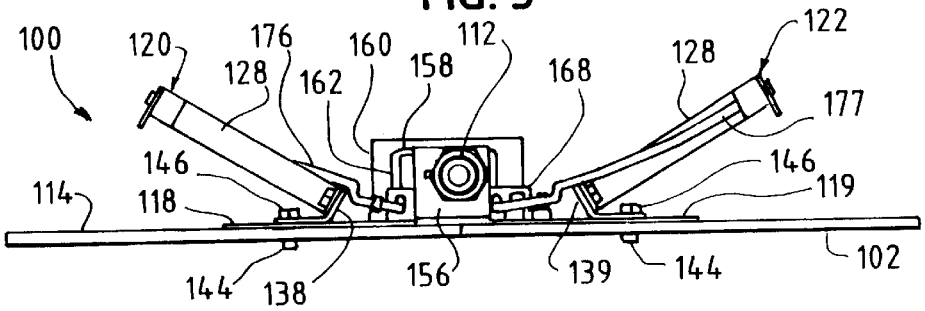
FIG. 3 is an end view of the antenna of FIG. 2.

Turning to FIGS. 2 and 3, ground plane 116 is mounted to the non-conductive antenna tray 102 via mounting screws 144 and nuts 146. Screws and nuts 144, 146 also act to fasten superimposed angled mounting brackets 138, 139 to ground plane 116. The angled mounting brackets 138, 139 in turn support first and second dipole antenna elements 120, 122, respectively. It should be noted that the dipole antenna elements described herein represent the presently preferred embodiment of the invention. It is clear, however, that to provide alternately configured radiating elements other than the dipoles illustrated may be employed. Mounting brackets 138, 139 as well as first and second dipole antenna elements 120, 122 may be identical, so for the sake of brevity only one of each will be described here in the knowledge that identical structures are to be found on the corresponding members.

Figure 5:
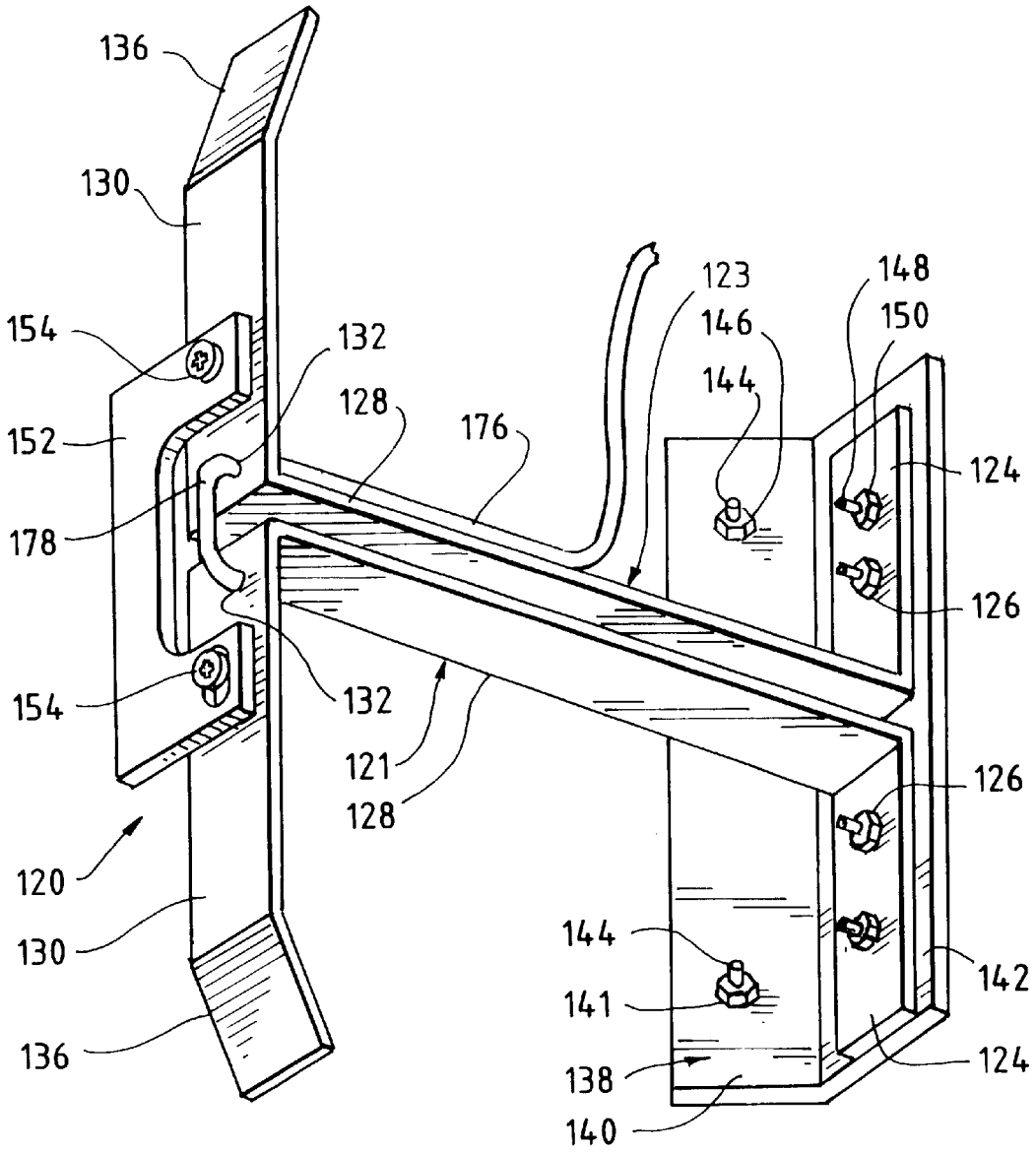
FIG. 5 is a perspective view of a single dipole and support structure according to the preferred embodiment of the invention.

As best seen in FIG. 5, mounting bracket 138 is formed from a single piece of sheet metal, preferably 16 gauge stainless steel. The bracket 138 comprises a first mounting surface 140 and a second mounting surface 142 angled relative to the first. Mounting holes 141 are formed in the first surface and are positioned to receive the mounting screws 144 for fastening the ground plane 116 to antenna tray 102. The angle between second mounting surface 142 and first mounting surface 140 is preferably in the range of between 120° to 130°. A radiating element support member 128 is mounted perpendicular to the second mounting surface. Thus, the angle formed between support member 128 and the tray 102 will be equal to the angle between the first and second mounting surfaces 140, 142 of bracket 138 minus 90°. In short, the radiating support member will form an angle relative to the antenna tray of between 30° to 40°.

Referring to FIG. 5, it will be seen that the dipole antenna element 120 consists of two identical radiating elements 121, 123. Each radiating element 121, 123 comprises a single long bar shaped section of silver coated brass having a rectangular cross section. The brass is bent into somewhat of a C-shaped configuration, having a short straight base section 124, a vertical extender/support section 128 formed 90° to base 124, and a radiating arm 130 angled 90° to the extender 128 and extending generally parallel to the base 124. The ends 136 of the radiating arms 130 are bent down slightly in the direction of the base, at an angle of about 30°. A pair of mounting holes 126 are formed in the base 124 and align with similarly positioned mounting holes formed in the angled mounting surface 142 of bracket 138. As shown, the two radiating elements 121, 123 are spaced apart and mounted back to back and secured to the second mounting surface 142 bracket 138 by fastening screws 148 and nuts 150. Thus, the upper radiating arms 130 of each radiating element 121, 123 extend in opposite directions, forming the two arms of the dipole 120.

A plastic spacer cam 152 may be provided to maintain the proper spacing between the radiating elements 121, 123. Brass screws 154 engage threaded holes formed in the radiating arms 130 of the radiating elements, securing the spacer cam to the radiating elements. The spacer cam 152 includes mounting holes 151, 153, at least one of which is slotted. Radiating elements 121, 123 may be moved closer together, or further apart, with the brass mounting screw 154 moving within the slotted opening. When the two radiating elements are properly positioned, the brass screw 154 may be tightened in order to maintain the proper spacing.

The upper radiating arms 130 of the two radiating elements 121, 123 further include small holes 132 for receiving a transmission line for connecting an RF signal to the dipole 120. As can be seen in FIG. 5, a 50 Ω coaxial cable 176 supplies the dipole 120. The outer shield of cable 176 is soldered along the length of the extender/support section 128 of radiating element 123. The shield is stripped and soldered at hole 132 in the radiating arm 130 of radiating element 123. The dielectric insulator 178 and center conductor 180 of cable 176 extend through the hole 132 in radiating element 123 and loop back toward radiating element 121. The dielectric 178 and center conductor 180 are inserted back through the hole 132 in the radiating arm 130 of radiating element 121, where the dielectric layer is stripped away, and the center conductor is soldered to the underside of the radiating arm 130 to produce electrical connection therewith.

Referring now to FIGS. 2 and 3, when radiating elements 121, 123 are mounted to bracket 138 as described, the extender/support members 128 extend upwardly at an acute angle relative to antenna tray 102. The actual angle formed between the antenna tray and the extender/support members is preferably in the range of between 30° to 40°. The dipole 120, comprising the two horizontally extending arms 130 of radiator elements 121, 123, is thereby supported a shorter distance above the tray 102 than the support/extender 128 would otherwise provide. Furthermore, the dipole 120 is offset in the outward direction relative to first reflector element 118. In the preferred embodiment, dipole 120 extends a total length of approximately 5.75" and is positioned approximately 2 inches above tray 102, and approximately 1 inch beyond the outer edge of reflector element 118.

For the best results in reflecting energy radiated toward the back of the antenna, reflector elements 118, 119 are optimally sized at least 5% and preferable between 5 to 10% greater than dipole 120, 122. Such a relationship increases resonance at the lower operating frequencies of the antenna, and enhances the directionality of the reflected field pattern. In the preferred embodiment the reflector elements 118, 119 are 6.25" long and 0.75" wide. As will be clear from an examination of the field patterns of an antenna built in accordance with the preferred embodiment of the invention, (see FIGS. 6 and 7), a major axis of a first main lobe of the antenna's field pattern is formed along an imaginary plane extending from the longitudinal axis of first reflector element 118, and the axis of dipole 120. The relative sizes and locations of the dipoles 120, 122 and the reflector elements 118, 119 may vary depending on the desired operating frequency of the antenna, and the desired direction of the lobes. To alter the direction of the field pattern lobes, the relative position between the dipoles 120, 122 and the reflector elements 118, 119 may be changed by altering the dimensions of the ground plane 116, changing the lengths of the extender/support members supporting the dipoles, or by changing the relative angles of the mounting surfaces 140, 142 of mounting brackets 138, 139.

As is clear from the end view of FIG. 3, second dipole 122 is mounted in the same manner as first dipole 120. However, second dipole 122 is angled in the opposite direction as first dipole 120. Thus, the angle formed between the antenna tray and the extender/support members supporting second dipole 122 will range between 30° and 40° but will be directed toward the opposite side of the antenna tray 102. As was the first dipole, second dipole 122 is supported a short distance above the tray 102, and is offset in the outward direction relative to second reflector element 119. Again as will be clear from an examination of the field patterns for the antenna of the present invention, a major axis of a second main lobe of the antenna's field pattern is formed along an imaginary plane extending from the longitudinal axis of the second reflector element 119, and the axis of dipole 122.

Returning to FIG. 2, the remaining components of antenna 100 include a power divider 158 for dividing an input signal between the two dipoles 120, 122, and a mounting bracket 168 for attaching the power divider to ground plane 116. The power divider 158 is a dielectric-substrated microstrip transformer formed by etching unwanted copper from a copper coated substrate of low-loss dielectric material 160. The etching process leaves microstrip transmission line sections 162 terminated in contact pads 164 for accommodating the connection of coaxial transmission lines to the power divider 158. A first coaxial transmission line 174 connects the power divider to RF connector 112, and second and third coaxial cables 176, 177 connect the output of power divider 158 to dipoles 120, 122. Power divider 158 is soldered to mounting bracket 168 and bracket 168 is secured to ground plane 116 by screws 170 and nuts 172 or some other metallic fastener such as rivets.

Referring to FIG. 1, radome 104 is positioned over dipoles 120, 122 as well as the other antenna components mounted to insulating antenna tray 102. The downwardly bent ends 136 of the radiating arms 130 of dipoles 120, 122 provide clearance for the tapered sidewalls 107 of radome 104. Thus, the length of the dipole elements may be sized properly for the frequency band of the antenna, while the radome may be constructed in a stronger, more durable configuration.

Figure 8:
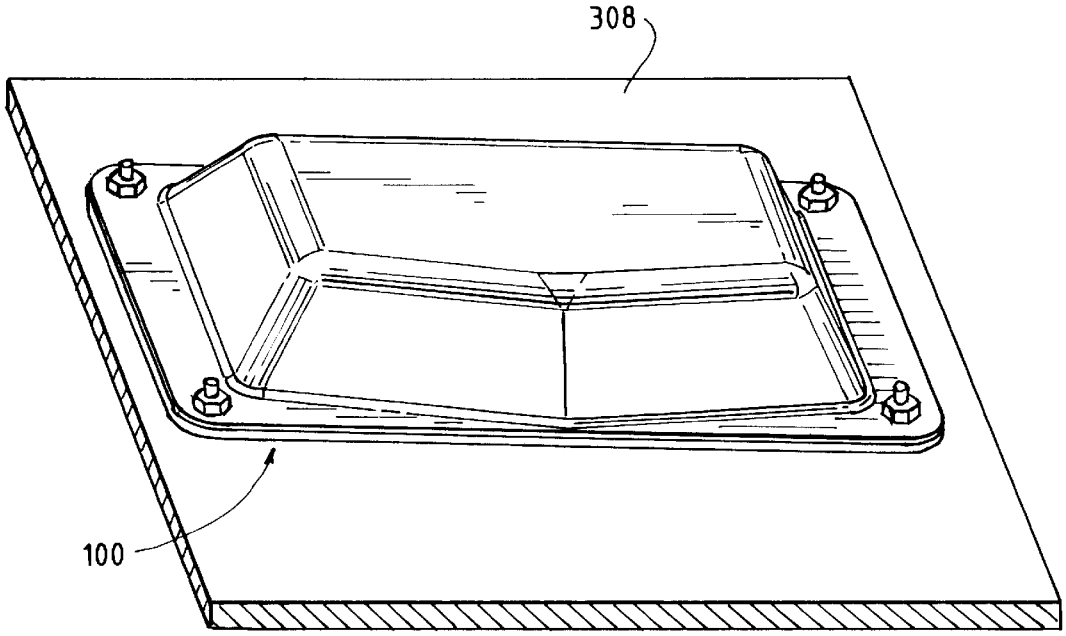
FIG. 8 is a perspective view of the antenna of FIGS. 1–5 mounted to a conductive or partially conductive surface.

Turning to FIG. 8, antenna 100 is shown mounted directly to a planar surface 250. Surface 250 may be formed of a metal such as steel, or some other conductive or semiconductive material. Further, surface 250 may be the inner lining of a tunnel, or the exterior surface of a building, or some other structure.

Figure 6A:
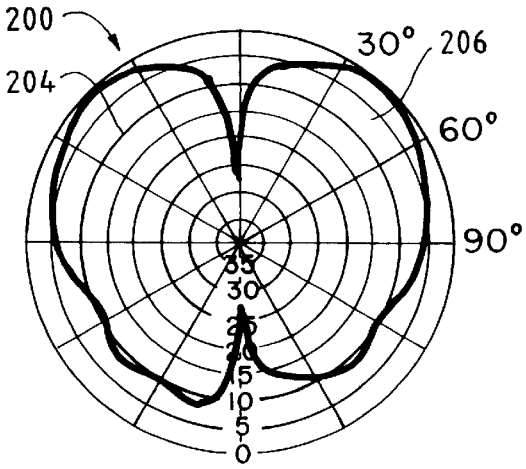
FIG. 6 shows the free space radiation pattern for the antenna of FIGS. 1–5.
Figure 6B:
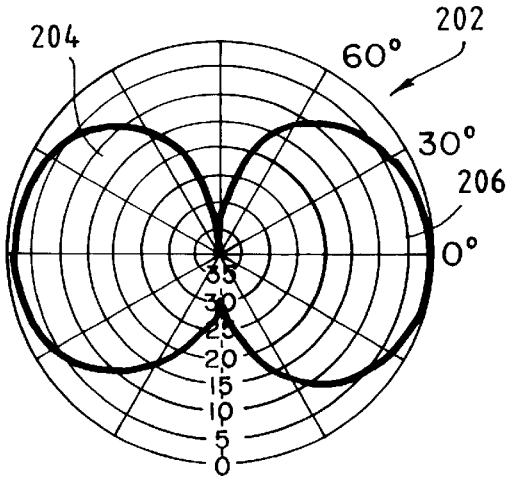
Figure 7A:
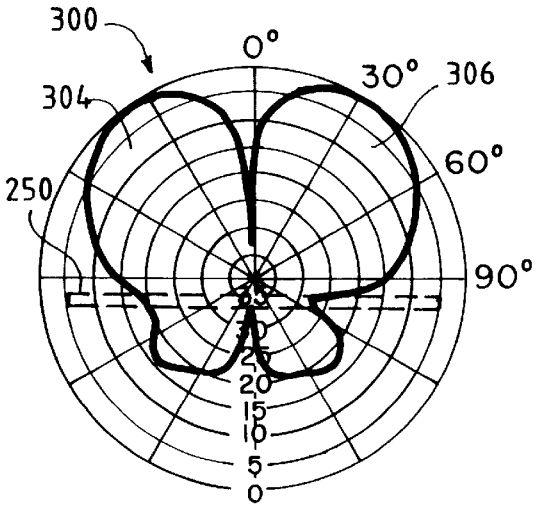
FIG. 7 shows the radiation pattern for the antenna of FIGS. 1–5, when mounted directly to a flat conductive surface.
Figure 7B:
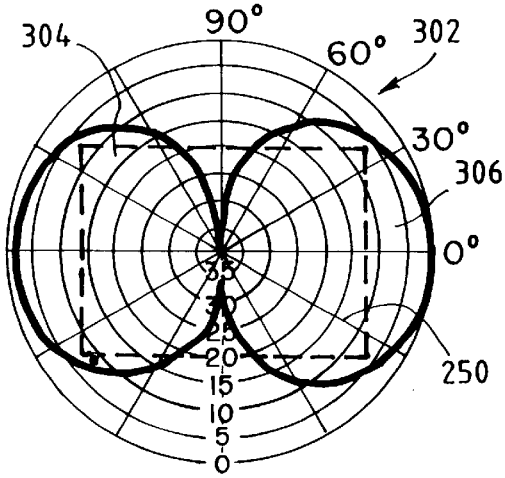

Turning now to FIGS. 6 and 7, the field patterns of an antenna built according to the preferred embodiment of the invention are shown. FIG. 6 shows the horizontal field pattern 200 and vertical field pattern 202 for the antenna in free space. FIG. 7 shows the horizontal field pattern 300, and vertical field pattern 302 for the antenna mounted directly to a surface 308 which is conductive. With regard to FIG. 6, the antenna produces two distinct lobes 204, 206 directed toward the sides of the antenna. Undesirably, a large amount of the radiated field is directed behind the antenna. However, comparing FIG. 6 to FIG. 7, mounting the antenna directly to a conductive surface significantly improves the radiated field pattern. Again, the pattern includes two distinct lobes 304, 306 directed toward the sides of the antenna. However, lobes 304, 306 are much more distinct and positively directed along the major axes defined by the antenna's radiators and reflectors. Further, the back radiation is significantly reduced relative to the free space mounting depicted in FIG. 6. A prototype built according to the preferred embodiment was constructed and mounted directly to a conductive surface. Under such conditions, a VSWR of less than 1.5:1 was measured at the operating frequency of the antenna.

From the radiation patterns of FIGS. 6 and 7, it is clear that the antenna of the present invention provides a highly effective low profile bi-directional antenna. The directivity of the two beams together with the ability to be mounted directly to a conductive surface without significant degradation to the field pattern, and while generating an acceptable VSWR, make the antenna of the present invention especially well adapted for providing mobile radio telephone coverage within tunnels and along densely constructed city streets. Because of the positive beam shaping effects of mounting the antenna directly to a conductive surface, the antenna may be mounted directly to the metallic lining of a tunnel, or the steel exterior of a building without adversely affecting the field pattern of the antenna.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

What is claimed is:

1. A low profile bi-directional antenna adapted for mounting directly to a conductive surface, the antenna comprising:

an insulating antenna tray having top and bottom surfaces;

a conductive ground plane having lateral side edges and mounted to one of the surfaces of the antenna tray;

first and second reflector elements mounted to a surface of the antenna tray laterally beyond said side edges of the ground plane and electrically connected thereto;

first and second radiating elements supported above the tray and the ground plane and spaced laterally beyond both said side edges and said first and second reflector elements respectively; and an RF connector for coupling RF signals to and from the first and second radiating elements.

2. The antenna of claim 1 wherein the first and second radiating elements comprise dipole radiators.

3. The antenna of claim 2 wherein the first and second reflector elements are at least 5% longer than the first and second dipole radiators.

4. The antenna of claim 1 wherein the ground plane is connected to earth ground through the RF connector.

5. The antenna of claim 1 further comprising a radome removably attachable to the antenna tray, the radome having tapered sides and a top surface sufficient to provide clearance of the radiating elements therewithin.

6. The antenna of claim 5 wherein the radiating elements comprise dipole radiators having first and second opposing ends which are bent toward the antenna tray to provide additional clearance within the radome.

7. The antenna of claim 1 mounted directly to a planar conductive surface and wherein a voltage standing wave ratio of less than 1.5:1 is generated with the antenna so mounted.

8. A bi-directional antenna comprising:

an insulating antenna tray;

a conductive ground plane mounted on the tray;

a pair of reflector elements electrically connected to the ground plane and mounted on the insulated tray on opposite sides of the ground plane, each reflector element defining an outer edge opposite the ground plane;

a first radiator positioned above the tray and laterally offset from the outer edge of the first reflector element, a second radiator positioned above the tray and laterally offset from the outer edge of second reflector element, the radiators being supported by angled support members mounted to the ground plane;

an RF connector; and transmission line means for conveying RF signals between the radiators and the connector.

9. The antenna of claim 8 further comprising a power divider having an input coupled to the RF connector, a first output coupled to the first radiator, and a second output coupled to the second radiator.

10. The antenna of claim 8 wherein the radiators comprise first and second dipoles having arms extending generally parallel to the surface of the tray.

11. The antenna of claim 10 further comprising a removable radome having tapered sidewalls, the dipole arms having bent end portions providing clearance between the dipoles and the tapered sidewalls.

12. The antenna of claim 10 wherein the reflectors have a length at least about 5% longer than the length of the dipoles.

13. The antenna of claim 12 further comprising a power divider having an input coupled to the RF connector, and a first output coupled to the first dipole, and a second output coupled to the second dipole.

14. The antenna of claim 10 further comprising first and second angled extenders electrically connected to the ground plane and supporting said first and second dipoles.

15. The antenna of claim 14 wherein the angled extenders form acute angles with the antenna tray in the range of from about 30° to 40°.

16. A bi-directional antenna having a relatively low VSWR comprising;

an at least partially conductive mounting surface;

an insulating antenna tray mounted to the at least partially conductive surface, the tray isolating the antenna from the at least partially conductive surface;

a conductive ground plane mounted to the tray;

a first reflector adjacent a first side of the ground plane, and a second reflector adjacent a second opposite side of the ground plane, the reflectors being electrically connected to the ground plane and defining outside edges opposite the ground plane;

a first radiating element supported above and laterally offset from the first reflector beyond the outside edge thereof, and a second radiating element supported above and laterally offset from the second reflector beyond the outside edge thereof; and means for coupling an RF signal to the first and second radiating elements.

17. The antenna of claim 16 wherein the at least partially conductive surface comprises an inner surface of a tunnel.

18. The antenna of claim 16 wherein the at least partially conductive surface comprises the outer surface of a building.

19. The antenna of claim 16 wherein the lateral offset of the first radiating element from the first reflector element generally defines a major axis of a first directional lobe, and the lateral offset of the second radiating element from the second reflector element generally defines a major axis of a second directional lobe.

20. The antenna of claim 16 wherein the first and second reflectors and the ground plane are formed from a single sheet of metal.

21. The antenna of claim 16 wherein the radiating elements are supported by angled extenders electrically connected to the conductive ground plane.

22. The antenna of claim 21 wherein the angled extenders form an acute angle with the antenna tray in the range of from about 30° to 40°.

23. The antenna of claim 21 further comprising an RF connector and a power divider, and transmission line means connecting the RF connector to the input of the power divider, and connecting the outputs of the power divider to the first and second radiating elements.

24. The antenna of claim 23 wherein the radiating elements comprise first and second dipoles.

25. The antenna of claim 24 further comprising a low profile protective radome.

26. The antenna of claim 25 wherein distal ends of the first and second dipoles are bent to accommodate the radome.

* * * * *